US009903065B2

(12) United States Patent
Favaro et al.

(10) Patent No.: US 9,903,065 B2
(45) Date of Patent: Feb. 27, 2018

(54) LAUNDRY WASHING MACHINE

(71) Applicant: Electrolux Home Products Corporation N.V., Brussels (BE)

(72) Inventors: Daniele Favaro, Venice (IT); Elena Pesavento, Porcia (IT); Elisa Stabon, Gorizia (IT); Maurizio Del Pos, Pordenone (IT)

(73) Assignee: Electrolux Home Products Corporation N.V., Brussels (BE)

( * ) Notice: Subject to any disclaimer, the term of this patent is extended or adjusted under 35 U.S.C. 154(b) by 0 days.

(21) Appl. No.: 14/424,853

(22) PCT Filed: Aug. 9, 2013

(86) PCT No.: PCT/EP2013/066752
§ 371 (c)(1),
(2) Date: Feb. 27, 2015

(87) PCT Pub. No.: WO2014/032944
PCT Pub. Date: Mar. 6, 2014

(65) Prior Publication Data

US 2015/0240408 A1 Aug. 27, 2015

(30) Foreign Application Priority Data

Aug. 29, 2012 (EP) ..... 12182224

(51) Int. Cl.
*D06F 39/08* (2006.01)
*D06F 39/02* (2006.01)
*D06F 39/10* (2006.01)

(52) U.S. Cl.
CPC ..... *D06F 39/083* (2013.01); *D06F 39/02* (2013.01); *D06F 39/085* (2013.01); *D06F 39/10* (2013.01)

(58) Field of Classification Search
CPC ..... D06F 39/083; D06F 39/085; D06F 39/10; D06F 39/02
See application file for complete search history.

(56) References Cited

U.S. PATENT DOCUMENTS 2,896,436 A * 7/1959 Buechler ..... D06F 39/087 134/57 R
3,162,032 A * 12/1964 Behrens ..... D06C 7/00 137/266

(Continued)

FOREIGN PATENT DOCUMENTS

CN 101177892 A 5/2008
CN 101696544 A 4/2010

(Continued)

OTHER PUBLICATIONS

Mar. 3, 2014—(WO) International Search Report—App PCT/EP2013/066752.

(Continued)

*Primary Examiner* — Michael Barr
*Assistant Examiner* — Benjamin L Osterhout
(74) *Attorney, Agent, or Firm* — Banner & Witcoff, Ltd.

(57) ABSTRACT

A laundry washing machine includes a washing tub (3) external to a rotatable washing drum (4) adapted to receive laundry. The machine further includes a water supply circuit (5) to supply water into the washing tub (3), a washing/rinsing products supplier (6) to supply washing/rinsing products into the washing tub (3), a liquid outlet circuit (25) suitable for withdrawing liquid from the washing tub (3) and conveying such a liquid to the outside. The machine further includes a first recirculation circuit (20) suitable for withdrawing liquid from the washing tub (3) and re-admitting such a liquid into a first region (3*b*) of said washing tub (3), wherein the first recirculation circuit (20) includes a first recirculation pump (21) suitable for forcing liquid inside the (Continued)

first recirculation circuit (20) and a second recirculation circuit (30) suitable for withdrawing liquid from the washing tub (3) and re-admitting such a liquid into a second region (3*c*) of the washing tub (3). The second recirculation circuit (30) includes a second recirculation pump (31) suitable for forcing liquid inside the second recirculation circuit (30).

14 Claims, 7 Drawing Sheets

(56) References Cited

U.S. PATENT DOCUMENTS

| | | | | |
|---|---|---|---|---|
| 3,305,093 | A | 2/1967 | Brubaker et al. | |
| 4,696,171 | A * | 9/1987 | Babuin | D06F 33/02 137/387 |
| 4,711,103 | A * | 12/1987 | Mori | D06F 33/02 68/12.05 |
| 4,986,093 | A * | 1/1991 | Pastryk | D06F 39/083 68/13 R |
| 4,987,627 | A | 1/1991 | Cur et al. | |
| 5,193,361 | A | 3/1993 | Singh et al. | |
| 5,493,745 | A * | 2/1996 | Hauch | D06F 39/083 68/18 D |
| 6,295,411 | B1 | 9/2001 | Fastman | |
| 7,454,927 | B2 * | 11/2008 | Luckman | D06F 43/00 68/13 R |
| 7,921,493 | B2 | 4/2011 | Kim et al. | |
| 2002/0032932 | A1 | 3/2002 | Kim et al. | |
| 2004/0244433 | A1 | 12/2004 | Lee et al. | |
| 2005/0183208 | A1 * | 8/2005 | Scheper | D06F 25/00 8/142 |
| 2006/0108454 | A1 | 5/2006 | Eichholz | |
| 2008/0216250 | A1 | 9/2008 | Lee et al. | |
| 2009/0094990 | A1 * | 4/2009 | Nitschmann | D06F 58/206 62/3.3 |
| 2009/0095030 | A1 | 4/2009 | Kang | |
| 2011/0056030 | A1 | 3/2011 | Bang et al. | |
| 2012/0036650 | A1 | 2/2012 | Hong et al. | |
| 2012/0137740 | A1 | 6/2012 | Kikikawa et al. | |
| 2012/0304394 | A1 | 12/2012 | Dawudian | |
| 2014/0096572 | A1 | 4/2014 | Kim et al. | |
| 2014/0109323 | A1 | 4/2014 | Kim et al. | |

FOREIGN PATENT DOCUMENTS

| | | | | |
|---|---|---|---|---|
| CN | 102021797 | A | 4/2011 | |
| CN | 102373602 | A | 3/2012 | |
| DE | 3401899 | A1 | 7/1985 | |
| DE | 3721433 | A1 | 1/1989 | |
| DE | 19814884 | A1 | 10/1999 | |
| EP | 0240992 | A2 | 10/1987 | |
| EP | 0386724 | A1 | 3/1990 | |
| EP | 0736626 | A2 | 10/1996 | |
| EP | 1967634 | A2 | 9/2008 | |
| EP | 2392720 | A1 | 12/2011 | |
| EP | 2423368 | A1 | 2/2012 | |
| ES | 293549 | U | 8/1986 | |
| JP | 2007111161 | A | 5/2007 | |
| KR | 20100082481 | A | 7/2010 | |
| WO | 20081119630 | A1 | 10/2008 | |
| WO | WO 2012163410 | A1 * | 12/2012 | D06F 35/00 |

OTHER PUBLICATIONS

Jan. 27, 2014—(WO) International Search Report—App PCT/EP2013/066734.
Apr. 1, 2016 (CN) First Office Action—App 201380044696.1.
Aug. 26, 2016 (CN) Chinese Office Action—App 201380044696.1.
Nov. 4, 2016 U.S. Non-Final Office Action—U.S. Appl. No. 14/424/887.

* cited by examiner

LAUNDRY WASHING MACHINE

Aspects of the present invention concerns the field of laundry washing techniques.

In particular, aspects of the present invention refers to a laundry washing machine capable of performing a more efficient washing cycle.

BACKGROUND

Nowadays the use of laundry washing machines, both "simple" laundry washing machines (i.e. laundry washing machines which can only wash and rinse laundry) and laundry washing-drying machines (i.e. laundry washing machines which can also dry laundry), is widespread.

In the present description the term "laundry washing machine" will refer to both simple laundry washing machines and laundry washing-drying machines.

Laundry washing machines generally comprise an external casing provided with a washing tub which contains a rotatable perforated drum where the laundry is placed.

A loading/unloading door ensures access to the drum.

Laundry washing machines typically comprise a water inlet circuit and a products supply unit for the introduction of water and washing/rinsing products (i.e. detergent, softener, etc.) into the tub.

Known laundry washing machines are also provided with water draining devices that may operate both during the initial phases of the washing cycle and at the end of the same to drain the dirty water.

According to the known technique, a complete washing cycle typically includes different phases during which the laundry to be washed is subjected to adequate treatments.

A washing cycle usually comprises a laundry wetting phase with addition of a washing detergent and a main washing phase during which the drum is rotated and the water contained therein is heated to a predetermined temperature based on the washing program selected by the user. During the main washing phase the drum is rotated, so as to apply also a mechanical cleaning action on the laundry. At the end of the main washing phase the drum is typically rotated at high rotational speed, in such a way that dirty washing liquid (i.e. water mixed with detergent and dirty particles) is extracted from the laundry, and this dirty washing liquid is drained by the water draining devices.

A successive step of the cycle typically comprises a rinsing phase which usually comprises one or more rinsing cycles. In the rinsing cycle, clean rinse water is first added to the laundry, so as to be absorbed by the laundry and remove from the latter detergent and/or dirty particles not previously removed by washing liquid, and then the drum is rotated to extract water and dirty particles/detergent from the laundry: the dirty water extracted is drained from the tub to the outside by the water draining devices.

After the rinsing phase, a final spinning phase allows the extraction of the residual water contained in the wet laundry.

The water extracted during the spinning phase is drained towards the outside by means of the water draining devices (during or after the spinning phase).

A laundry washing machine performing a washing cycle is disclosed in document CN101696544A.

Such laundry washing machine comprises a tub having a cylindrical structure for containing washing water and a rotary drum rotatably installed in the tub.

The machine further comprises a recirculating circuit having one recirculating pump which withdraws liquid from the bottom of the tub and re-admits such liquid at the bottom of the tub or into an upper portion of the tub.

Therefore, a first liquid circuit recirculates liquid at the bottom of the tub and a second liquid circuit recirculates liquid at the upper portion of the tub.

At this purpose, the recirculating pump outlet is connected to a three-way valve, with one inlet and two outlets, which selectively diverts liquid from the bottom of the tub again to the bottom of the tub or to the upper portion of the tub by means of respective pipes connected to the outlets.

The liquid is re-circulated at the bottom of the tub in the first liquid circuit when the dissolution of the detergent inside the tub is required.

The liquid is re-circulated in the second liquid circuit at the upper portion of the tub in order to increase the absorption of the liquid by the laundry inside the tub.

The choice between the first and the second liquid circuit is therefore carried out by properly controlling the three-way valve.

SUMMARY

It is an object of the invention to improve the washing efficiency of a laundry washing machine of the known type, as above described.

It is another object of the invention to provide a laundry washing machine that makes it possible to control efficiently the recirculation of liquid inside the tub.

The applicant has found that by providing a laundry washing machine comprising a washing tub external to a rotatable washing drum adapted to receive laundry, a first recirculation circuit suitable for withdrawing liquid from the washing tub and to re-admit such a liquid into a first region of the washing tub, a second recirculation circuit suitable for withdrawing liquid from the washing tub and to re-admit such a liquid into a second region of the washing tub, and by providing a first recirculation pump suitable for forcing liquid inside the first recirculation circuit and a second recirculation pump suitable for forcing liquid inside the second recirculation circuit, it is possible to obtain a laundry washing machine having an increased washing efficiency compared to the machines of known type.

Advantageously, it is possible to control independently the two recirculation circuits.

Aspects of the present invention relates, therefore, to a laundry washing machine comprising:

- a washing tub external to a rotatable washing drum adapted to receive laundry;
- a water supply circuit to supply water into the washing tub;
- a washing/rinsing products supplier to supply washing/rinsing products into the washing tub;
- a liquid outlet circuit suitable for withdrawing liquid from the washing tub and to convey such a liquid to the outside;
- a first recirculation circuit suitable for withdrawing liquid from said washing tub and to re-admit such a liquid into a first region of said washing tub, said first recirculation circuit comprising a first recirculation pump suitable for forcing liquid inside said first recirculation circuit;
- a second recirculation circuit suitable for withdrawing liquid from said washing tub and to re-admit such a liquid into a second region of said washing tub;

the second recirculation circuit comprises a second recirculation pump suitable for forcing liquid inside the second recirculation circuit.

Preferably, the machine further comprises a filtering device fluidly connected to an outlet of the washing tub, wherein the first recirculation pump is connected to a first outlet of the filtering device and the second recirculation pump is connected to a second outlet of the filtering device.

More preferably, the first outlet of the filtering device and the second outlet of the filtering device are arranged at opposite sides with respect a central plane intersecting the filtering device.

In a preferred embodiment of the invention, the liquid outlet circuit comprises a draining pump connected downstream of the filtering device.

In another preferred embodiment of the invention, the liquid outlet circuit comprises a draining pump, the draining pump being connected downstream of a second filtering device.

Preferably, the first region of the washing tub is a higher region with respect to the second region of the washing tub. In other words, the first region is placed, when the laundry machine is its operating position (i.e. installed for example on the floor of a building), at a height higher than the second region.

Preferably, the first recirculation circuit is arranged in such a way that the recirculated liquid is conveyed to the laundry, so as to wet the latter.

Advantageously, the second recirculation circuit re-admits the liquid into a lower region of the washing tub so as to improve the dissolution of the washing/rinsing product collected therein.

In a preferred embodiment of the invention, the second recirculation circuit re-admits the liquid into a lower seat of the washing tub which receives a heater device.

Opportunely, the first recirculation pump and the second recirculation pump are mounted on a support body obtained in a single piece construction.

Advantageously, the support body comprises a first inlet and a first outlet for the first recirculation pump and comprises a second inlet and a second outlet for the second recirculation pump.

In a preferred embodiment of the invention, the machine of the invention is a laundry washing-drying machine.

BRIEF DESCRIPTION OF THE DRAWINGS

Further characteristics and advantages of the present invention will be highlighted in greater detail in the following detailed description of a preferred embodiment of the invention, provided with reference to the enclosed drawings. In said drawings.

DETAILED DESCRIPTION

Aspects of the present invention have proved to be particularly advantageous when applied to laundry washing machines, as described below. It should in any case be underlined that the present invention is not limited to laundry washing machines. On the contrary, the present invention can be conveniently applied to laundry washing-drying machines (i.e. laundry washing machines which can also dry laundry).

In the present description, therefore, the term "laundry washing machine" will refer to both simple laundry washing machines and laundry washing-drying machines.

Figure 1:
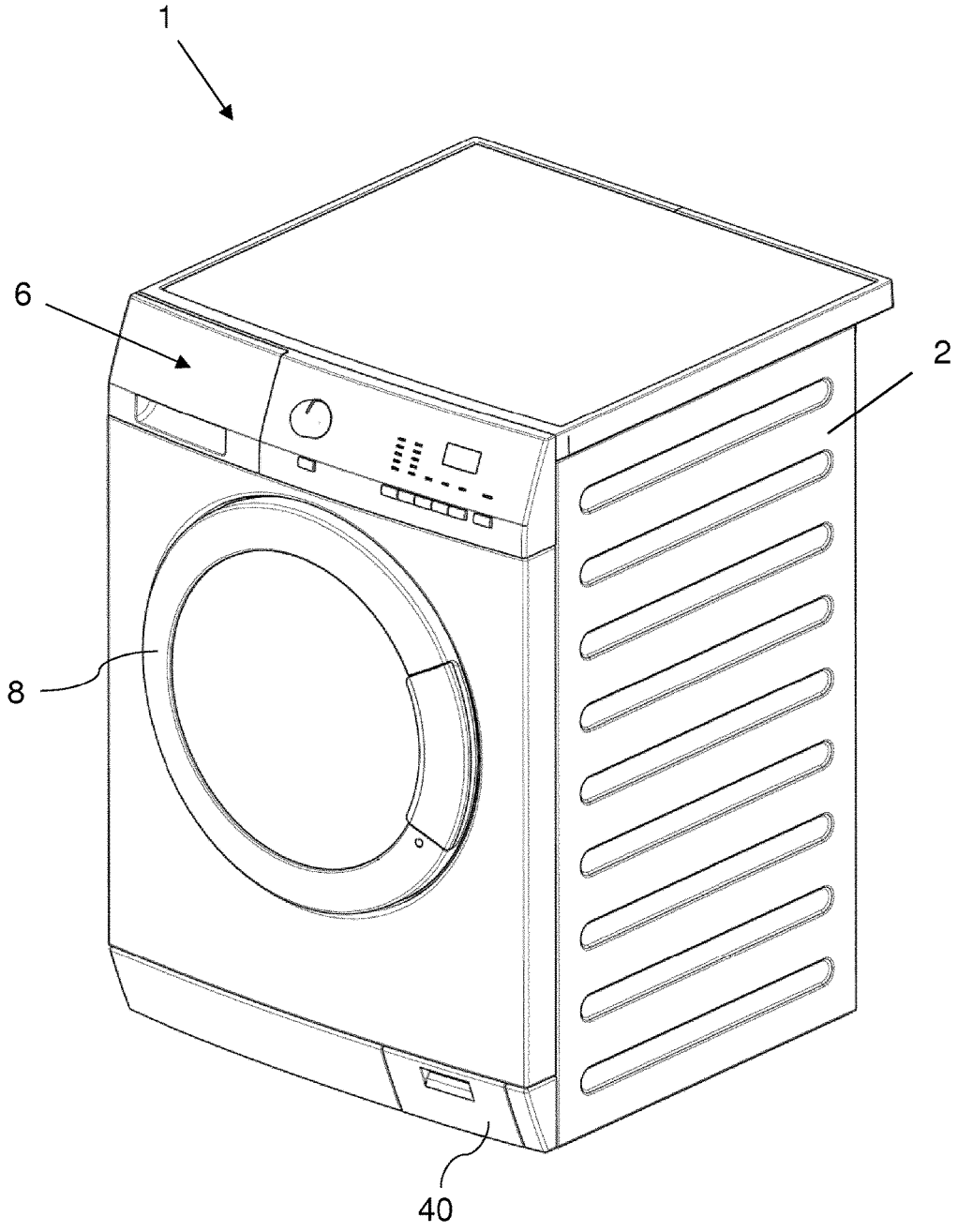
FIG. 1 shows a perspective view of a laundry washing machine according to a preferred embodiment of the invention.
Figure 2:
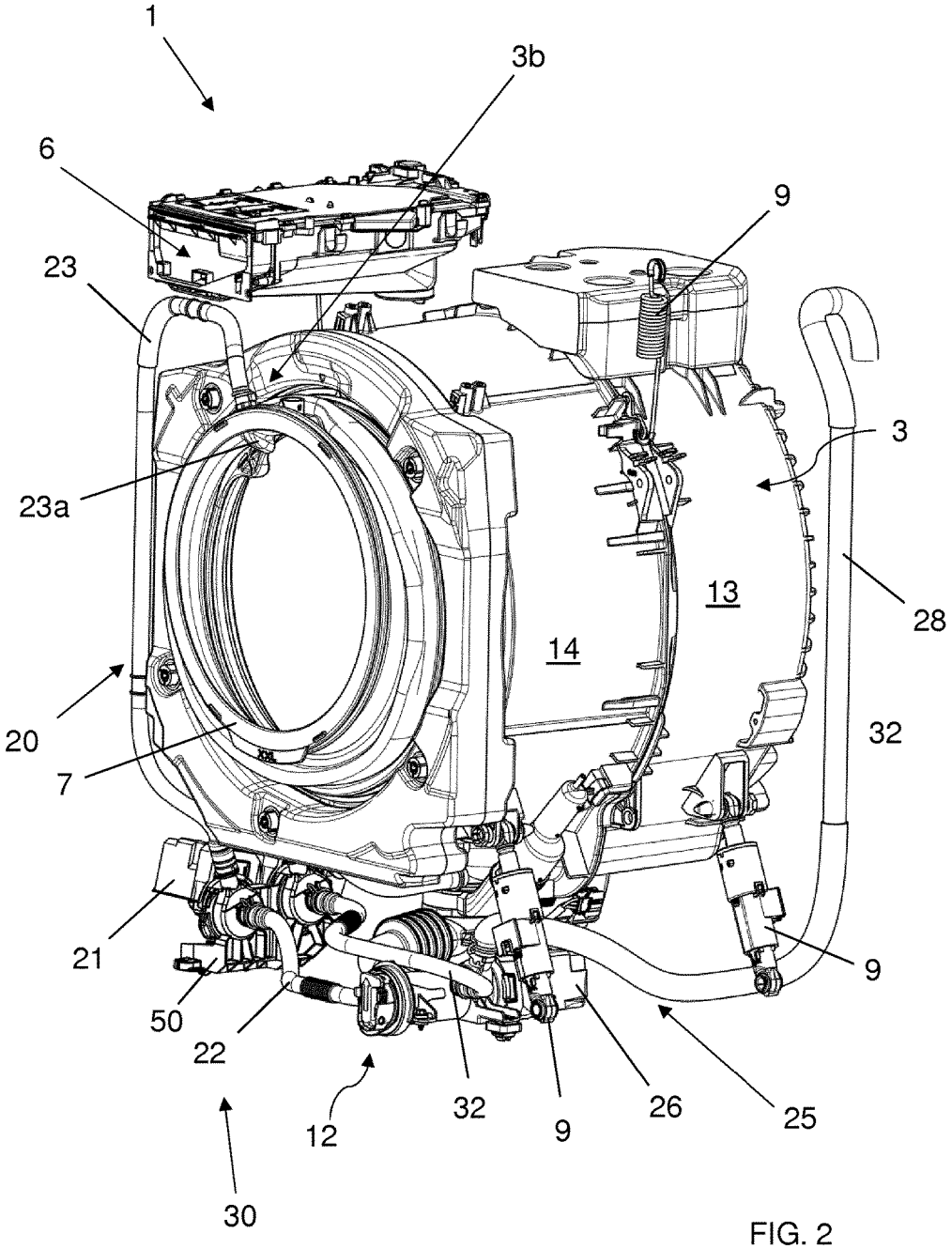
FIG. 2 shows the laundry washing machine of FIG. 1 with the external casing removed and with some parts removed.
Figure 3:
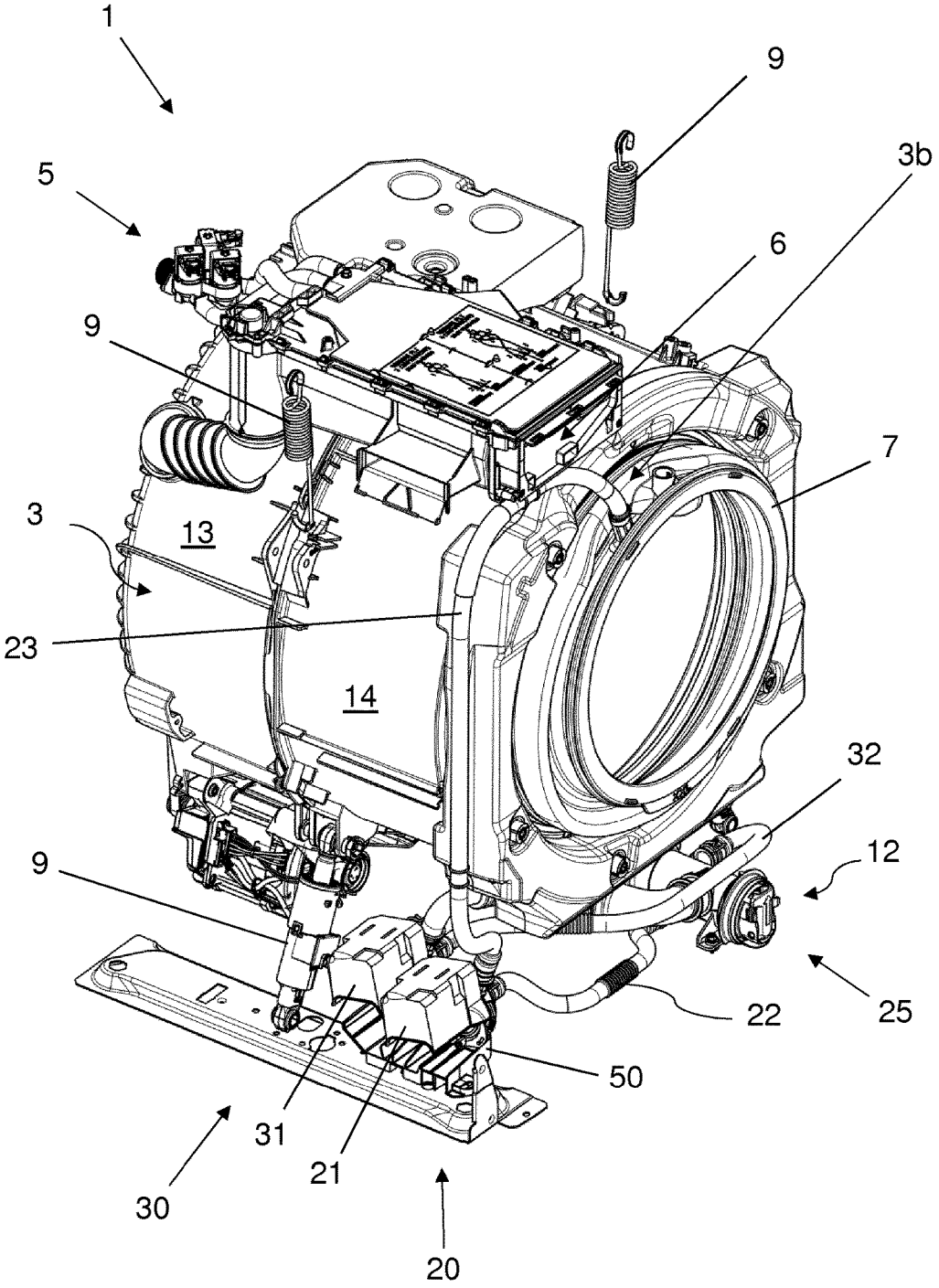
FIG. 3 shows the laundry washing machine of FIG. 2 from another point of view.

FIG. 1 shows a laundry washing machine 1 according to a preferred embodiment of the invention.

Figure 6:
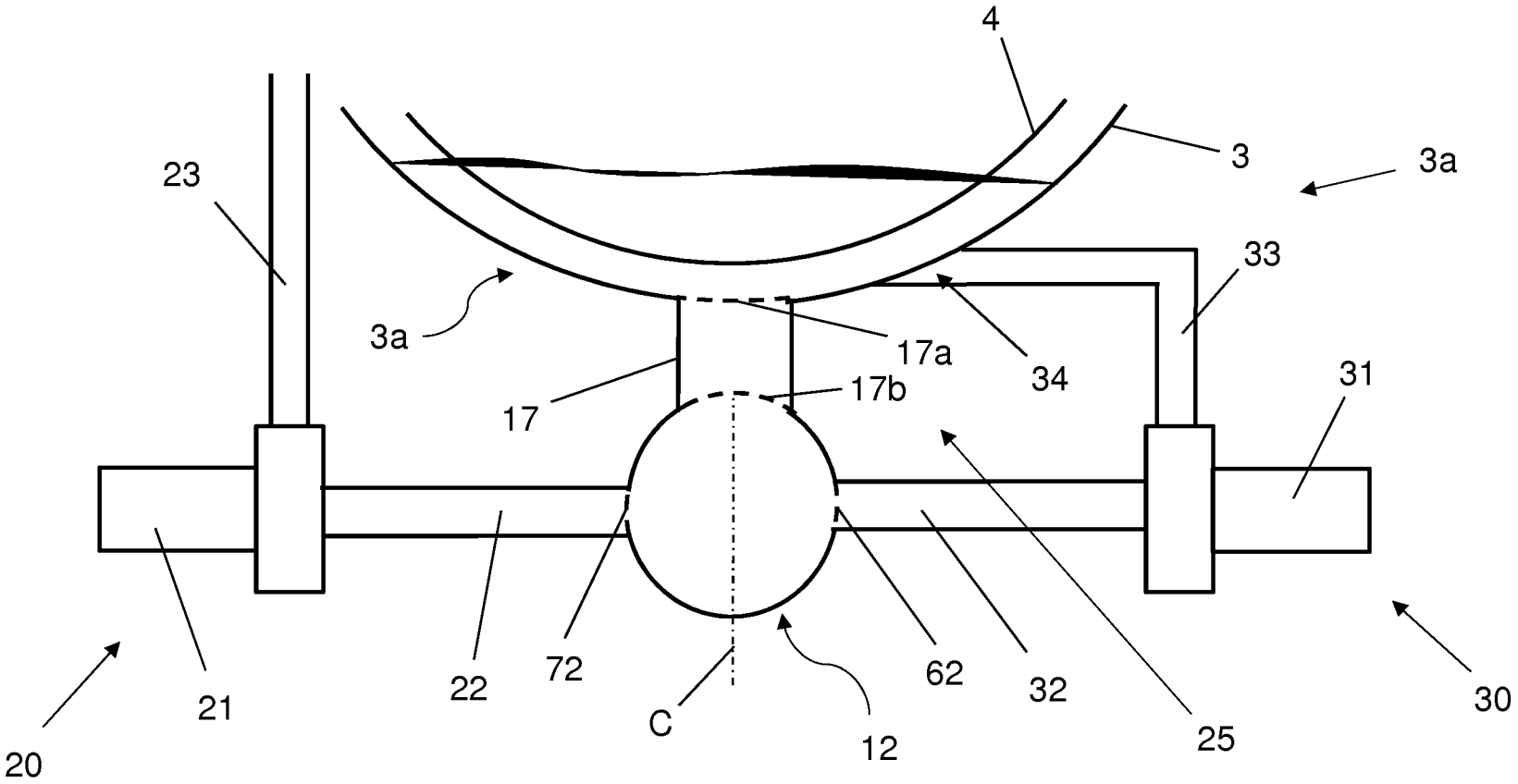
FIG. 6 is a schematic view of a detail of the laundry washing machine of the invention.

The laundry washing machine 1 comprises an external casing or housing 2, in which a washing tub 3 is provided that contains a rotatable perforated drum 4, visible in the schematic view of FIG. 6, where the laundry to be treated can be loaded.

The tub 3 and the drum 4 both preferably have a substantially cylindrical shape. The housing 2 is provided with a loading/unloading door 8 which allows access to the washing drum 4.

The tub 3 is preferably suspended in a floating manner inside the housing 2, advantageously by means of a number of coil springs and shock-absorbers 9.

The drum 4 is advantageously rotated by an electric motor, not illustrated, which preferably transmits the rotating motion to the shaft of the drum 4, advantageously by means of a belt/pulley system. In a different embodiment of the invention, the motor can be directly associated with the shaft of the drum 4.

The tub 3 is preferably connected to the casing 2 by means of an elastic bellows 7, or gasket.

The tub 3 preferably comprises two complementary hemi-shells 13 and 14 structured for being reciprocally coupled to form the tub 3.

Figure 4:
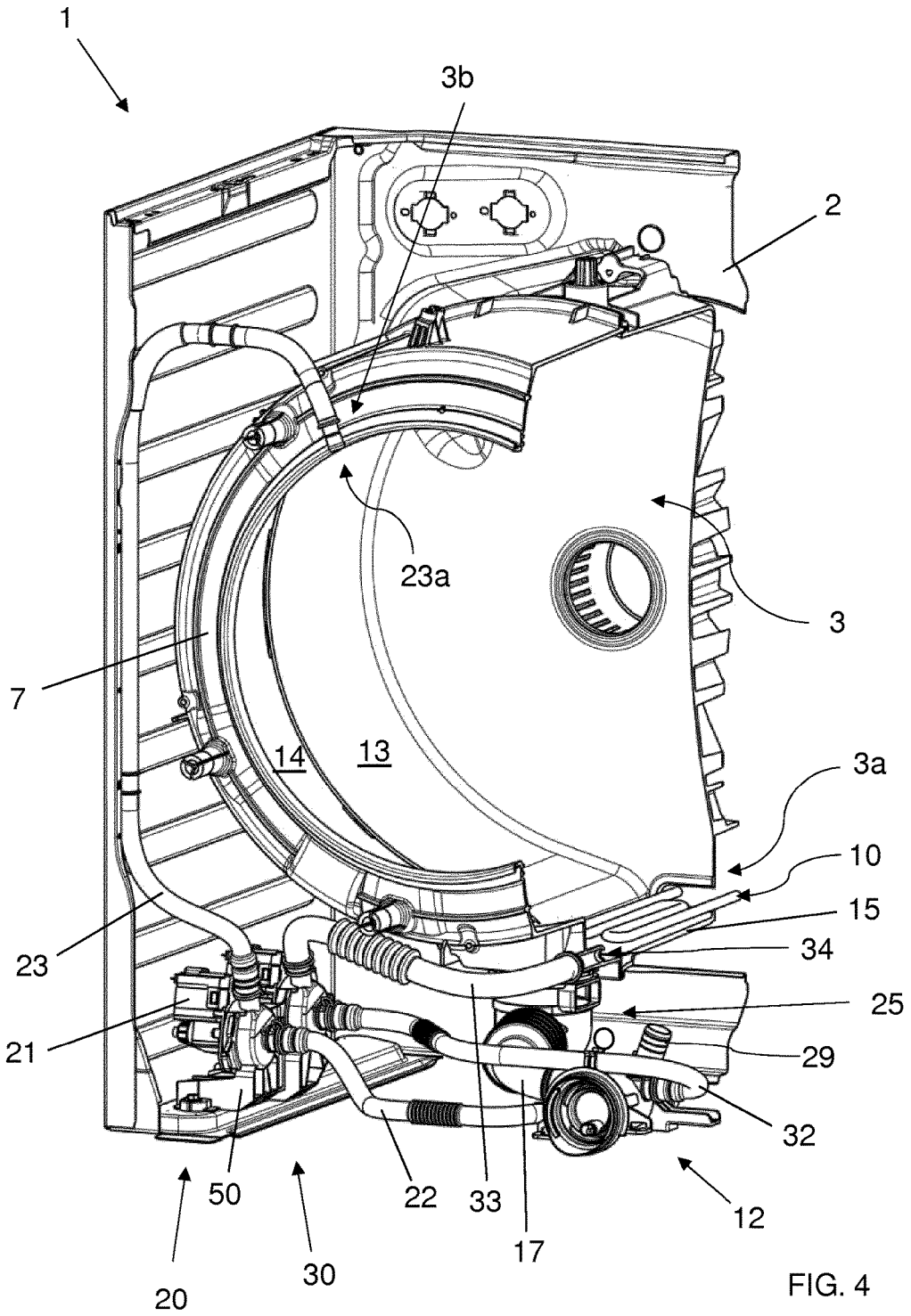
FIG. 4 shows a partial view of the laundry washing machine of FIG. 1 with the external casing partially removed and some parts removed.

The lower portion 3*a* of the tub 3, or bottom of the tub, preferably comprises a seat 15 suitable for receiving a heater device 10, as illustrated in FIG. 4.

The heater device 10 preferably comprises an electrical resistor of serpentine type. The heater device 10 is advantageously horizontally placed in the seat 15 and it preferably extends substantially from the front part up to the rear part of the seat 15.

A water supply circuit 5 is arranged in the upper part of the laundry washing machine 1 and is suited to supply water into the tub 3. The water supply circuit of a laundry washing machine is well known in the art, and therefore it will not be described in detail.

The laundry washing machine 1 advantageously comprises a removable drawer 6 provided with various compartments suited to be filled with washing and/or rinsing products (i.e. detergent, softener, etc.).

In a preferred embodiment, the water is supplied into the tub 3 from the water supply circuit 5 by making it flow through the drawer 6.

The water which reaches the tub 3 can, in this case, selectively contain one of the products contained in the compartments of the drawer 6, or such water can be clean and in this case it may reach the tub 3 directly, bypassing the compartments of the drawer 6.

In an alternative embodiment of the invention, a further separate water supply pipe can be provided, which supplies exclusively clean water into the tub 3.

Laundry washing machine 1 advantageously comprises a water outlet circuit 25 suitable for withdrawing liquid from the lower portion 3*a* of the tub 3.

The water outlet circuit 25 preferably comprises a main pipe 17, a draining pump 26 and an outlet pipe 28 ending outside the housing.

The water outlet circuit 25 preferably further comprise a filtering device 12 arranged between the main pipe 17 and the draining pump 26. The filtering device 12 is adapted to retain all the undesirable bodies (for example buttons that have come off the laundry, coins erroneously introduced into the laundry washing machine, etc.) present inside the tub 3 during the draining of the washing/rinsing liquid through the water outlet circuit 25.

This filtering device 12 can preferably be removed, and then cleaned, through a gate 40 placed advantageously on the front wall of the housing 2 of the laundry washing machine 1.

The main pipe 17 connects the lower portion 3*a* of the tub 3 to the filtering device 12. An inlet end 17*a* (see FIG. 6) of the main pipe 17 is advantageously positioned at the lower point of the tub 3, more preferably at the lower point of the seat 15 (if the seat 15 is provided).

Figure 5:
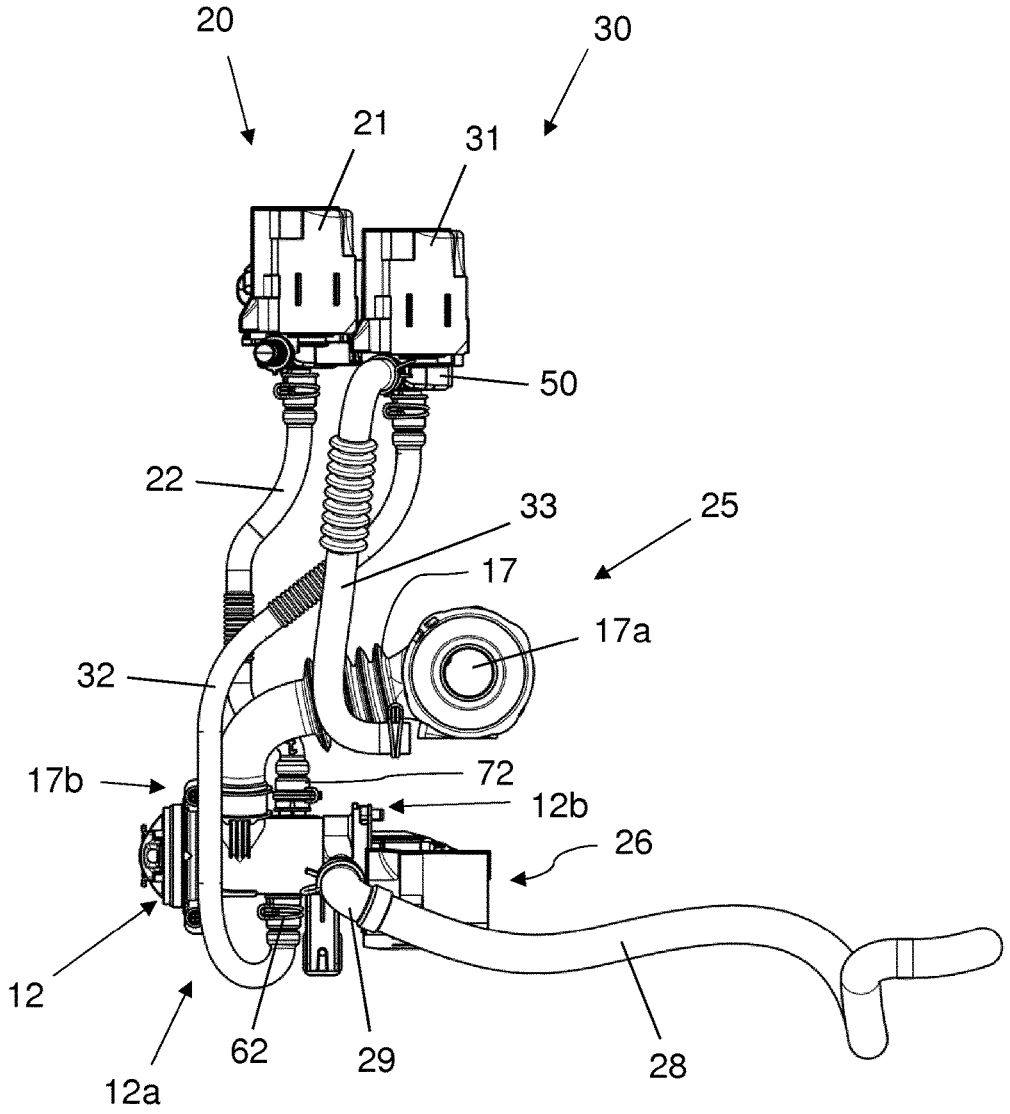
FIG. 5 is a plan view of some components of the laundry washing machine of FIG. 3 isolated from the rest.

An outlet end 17*b* (see FIG. 6) of the main pipe 17 is connected to the filtering device 12, preferably to a front part 12*a* of the filtering device 12, as illustrated in FIG. 5.

In a further embodiment, not illustrated, the filtering device 12 may be provided directly in the tub 3, preferably obtained in a single piece construction with the latter or more preferably with one of the shells composing the latter or partially with one shell and partially with another shell. In this case the filtering device 12 is fluidly connected to the outlet of the tub 3 in such a way that water and washing liquid drained from the tub 3 enters the filtering device 12.

The draining pump 26 is preferably connected to a rear part 12*b* of the filtering device 12 and conveys the liquid to the outlet pipe 28 through an outlet 29, the latest better visible in FIG. 4, in which the outlet pipe 28 has been removed for more clarity.

Activation of the drain pump 26 drains the liquid, i.e. water or water mixed with washing and/or rinsing products, from the tub 3 to the outside.

Laundry washing machine 1 advantageously comprises a first recirculation circuit 20 adapted to drain liquid from the lower portion 3*a* of the tub 3 and to re-admit such a liquid into a first region 3*b*, advantageously an upper region, of the tub 3.

Laundry washing machine 1 advantageously further comprises a second recirculation circuit 30 adapted to drain liquid from the lower portion 3*a* of the tub 3 and to re-admit such a liquid (recirculated mixing liquid) into a second region 3*c* of the tub 3, which preferably corresponds substantially to the same lower portion 3*a* of the tub 3.

The first recirculation circuit 20 preferably comprises a first recirculation pump 21, a first pipe 22 connecting the filtering device 12 to the first recirculation pump 21 and a first recirculation pipe 23, preferably provided with a terminal nozzle 23*a* arranged preferably at an upper region of the tub 3.

The liquid from the lower portion 3*a* of the tub 3 is conveyed towards the upper region of the tub 3 by activation of the first recirculation pump 21.

The first recirculation circuit 20 is advantageously activated in order to improve wetting of the laundry inside the drum 4.

In general, the first recirculation circuit is properly realized for transferring a portion of a liquid from a region of the tub to another region of the tub in order to enhance absorption of washing liquid by the laundry.

In fact, during a washing cycle, one or more initial phases provides for the addition of a quantity of water and washing products inside the tub 3. The water and the washing products are intended to wet the laundry inside the drum 4.

The second recirculation circuit 30 preferably comprises a second recirculation pump 31, a second pipe 32 connecting the filtering device 12 to the second recirculation pump 31 and a second recirculation pipe 33 advantageously provided with a terminal portion 34, better visible in FIG. 4. The terminal portion 34 advantageously ends in the lower portion 3*a* of the tub 3, preferably inside the seat 15, if the latter is provided.

The liquid from the lower portion 3*a* of the tub 3 is conveyed again towards the lower portion 3*a* of the tub 3 by activation of the second recirculation pump 31.

The second recirculation circuit 30 is advantageously activated when a further mixing and/or dissolution of the washing products is needed.

In general, the second recirculation circuit is properly realized for transferring a portion of a liquid from a bottom region of the tub to the same bottom region for mixing and/or dissolution of the washing products.

During a washing cycle, one or more phases provides for the addition of a quantity of washing products inside the tub 3, for example a detergent in the initial phases of the washing cycle or a rinsing product in the final phases of the washing cycle. The washing products, or the rinsing products, which are introduced into the washing tub 3 due to their high density move towards the lower part 3*a* of the tub 3. These products accumulate in the seat 15 which receives the heater device 10.

To achieve the dissolution of the products which accumulate in said seat 15, the terminal portion 34 of the second recirculation pipe 33 advantageously forces the recirculated mixing liquid along a main direction and collides with the product accumulated in the lower portion 3*a* of the tub 3 or seat 15, if the latter is provided.

Advantageously, the terminal portion 34 of the second recirculation pipe 33 according to the invention avoids accumulation of products at the bottom of the tub 3 and enhances a complete and/or a fast dissolution of the products themselves in the water.

The washing performance of the washing cycle and the efficiency of the machine 1 are therefore increased.

Furthermore, all the products introduced by the user in the drawer 6 is used in the washing cycle without any losses.

Still advantageously, the second recirculation circuit 30 performs a cleaning effect since no products accumulate at the bottom of the tub 3.

This guarantees good hygienic conditions inside the tub 3, in particular when the laundry washing machine in not used for a long time between two successive washing cycles.

According to the invention, activation of the first recirculation circuit 20 and activation of the second recirculation circuit 30 may be advantageously carried out independently one to the other by means of activation of the respective first and second recirculation pumps 21, 31.

During the washing cycle, therefore, and in particular during the initial phases of the washing cycle, the wetting of the laundry may be carried out independently from the dissolution of the product/products at the bottom 3*a* of the tub 3.

The washing performance of the washing program and the efficiency of the machine 1 are therefore increased.

Another aspect of the invention is disclosed hereinafter with reference to FIG. 6, wherein only the first and the second recirculation circuits 20, 30 are schematically illustrated. The first and the second recirculation pumps 21, 31 communicate with the lower part 3*a* of the tub 3 by means the first and second pipe 22, 32 which both withdraw liquid from the lower part 3*a* of the tub 3 via the filtering device 12. The filtering device 12 in turn communicates with the lower part 3*a* of the tub 3 by means of the main pipe 17, as already described above.

The first pipe 22 is connected to a first outlet 72 of the filtering device 12 and the second pipe 32 is connected to a second outlet 62 of the filtering device 12.

The first and the second recirculation pumps 21, 31, therefore, are arranged downstream the filtering device 12 and, if advantageously provided, the main pipe 17.

It is underlined that the term "downstream" is referred to the flowing direction of the liquid inside the recirculation circuit during the functioning of the pump; for example saying that the recirculation pump 21 is arranged downstream the filtering device 12 means that while the pump is working the liquid firstly passes through the filtering device 12 and then flows into the recirculation pump 21.

In a first advantageous aspect, the filtering device 12 retains all the undesirable bodies (for example buttons that have come off the laundry, coins erroneously introduced into the laundry washing machine, etc.) which may reach the recirculation pumps 21, 31.

This advantageously guarantees a good protection of the recirculation pumps 21, 31.

In a further advantageous aspect, the arrangement of the filtering device 12 between the recirculation pumps 21, 31 and the main pipe 17 guarantees that the two recirculation circuits 20, 30 work substantially independently one to the other. More particularly, the interposition of the filtering device 12 avoids that during the activation of one of, or both, the recirculation pumps 21, 31 air is sucked inside the activated pump/s, which would cause malfunctioning of the same.

For example, if the first recirculation pump 21 is activated in order to re-circulate liquid from the bottom 3*a* of the tub 3 while the second recirculation pump 31 is off, the presence of filtering device 12 guarantees that the liquid is all substantially withdrawn from the first pipe 17 connected to the bottom 3*a* of the tub 3, while substantially no liquid is sucked from the second pipe 32 of the second recirculation circuit 30. This substantially avoids that any liquid and/or air is sucked from the second recirculation circuit 30 and reaches the first recirculation pump 21.

The first recirculation circuit 20 may therefore work properly without any interaction with the second recirculation circuit 30 and the first recirculation pump 21 may work properly without risks of air sucking (which could negatively affect the performances of the pumps).

Analogously, if the second recirculation pump 31 is activated in order to re-circulate liquid inside the tub 3 while the first recirculation pump 21 is off, the presence of filtering device 12 guarantees that the liquid is all substantially withdrawn from the first pipe 17 connected to the bottom 3*a* of the tub 3, while substantially no liquid is sucked from the first pipe 22 of the first recirculation circuit 20. This substantially avoids that any liquid and/or air is sucked from the first recirculation circuit 20 and reaches the second recirculation pump 31.

The second recirculation circuit 30 may therefore work properly without any interaction with the first recirculation circuit 20 and the second recirculation pump 31 may work properly without risks of air sucking.

Also, if both the first and the second recirculation pumps 21, 31 are activated, the presence of filtering device 12 guarantees that the liquid is all substantially withdrawn from the first pipe 17 connected to the bottom 3*a* of the tub 3, while substantially no liquid is sucked from the first pipe 22 and the second pipe 32 of the first and second recirculation circuits 20, 30. This substantially avoids that air is sucked from the first recirculation pump 21 or the second recirculation pump 31.

Due to the presence of the filtering device, therefore, the two recirculation circuits 20, 30 may work properly without any interaction between them and therefore without risks of air sucking for the two recirculation pumps 21, 31.

In fact, during the activation of one or both the first and second recirculation pumps, when the body of the filtering device 12 is full of washing/rinsing liquid, due to the presence of this liquid also in correspondence to the first outlet 62 and second outlet 72, air can't pass from the first outlet 62 of the filtering device 12 to the second outlet 72 or viceversa.

Preferably, the first outlet 62 of the filtering device 12 and the second outlet 72 of the filtering device 12 are arranged at opposite side of the filtering device 12 with respect to a central plane C intersecting the filtering device 12 itself, as illustrated in FIG. 6. This enhances the independent functioning of the two recirculation circuits 20, 30, because this reciprocal positioning of the first and second outlets allows reducing the risk that one of them is not covered by the washing/rinsing liquid while the latter, sucked by the respective pump, is entering the other outlet.

Figure 7:
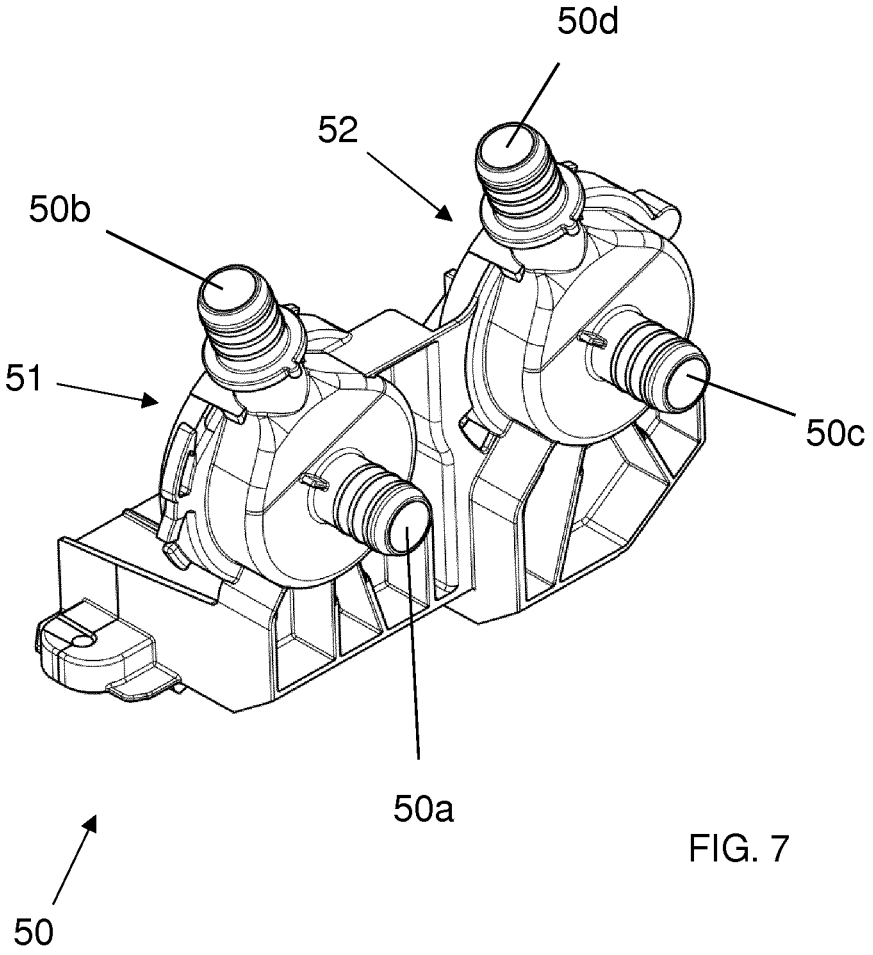
FIG. 7 shows an isometric view of a detail of the laundry washing machine illustrated in FIG. 4.

FIG. 7 represents a further advantageous aspect of the present invention. The figure shows the support body 50 of the two recirculation pumps 21, 31, also visible in FIGS. 2 to 5.

The support body 50 preferably comprises two receiving seats 51, 52 where the two recirculation pumps 21, 31 are mounted.

The support body 50 preferably comprises a first inlet 50*a* for the connection of the first pipe 22, a first outlet 50*b* for the connection of the first recirculation pipe 23, a second inlet 50*c* for the connection of the second pipe 32 and a second outlet 50*d* for the connection of the second recirculation pipe 33.

Therefore, the support body 50 comprises a first inlet 50*a* and a first outlet 50*b* for the first recirculation pump 21 and comprises a second inlet 50*c* and a second outlet 50*d* for the second recirculation pump 31.

The support body 50 is advantageously obtained in a single piece construction, preferably by injection moulding.

The support body 50 therefore define a completed, integral, unitary member.

Installation of the two recirculation pumps 21, 31 is therefore simplified.

Furthermore, the integral, unitary member of the support body 50 reduces risks of failure and increases reliability of the laundry washing machine 1.

In a further embodiment, not illustrated, the first and the second recirculation circuits may be completely separated from the water outlet circuit: in this case a second filtering device may be advantageously separately associated to the water outlet circuit, while a first common filtering device may be advantageously associated to the two recirculation circuits, substantially as described above.

It has thus been shown that the present invention allows all the set objects to be achieved. In particular, it makes it possible to obtain a laundry washing machine with improved washing efficiency with respect to the machines of the prior art. While the present invention has been described with reference to the particular embodiments shown in the figures, it should be noted that the present invention is not limited to the specific embodiments illustrated and described herein; on the contrary, further variants of the embodiments described herein fall within the scope of the present invention.

The invention claimed is:

1. A laundry washing machine comprising:

a washing tub external to a rotatable washing drum adapted to receive laundry;

a water supply circuit configured to supply water into said washing tub;

a washing/rinsing products supplier configured to supply washing/rinsing products into said washing tub;

a liquid outlet circuit configured to withdraw liquid from said washing tub and to convey liquid to an outlet;

a first recirculation circuit configured to withdraw liquid from said washing tub and to re-admit liquid into a first region of said washing tub, said first recirculation circuit comprising a first recirculation pump configured to force liquid inside said first recirculation circuit directly from said washing tub; and a second recirculation circuit configured to withdraw liquid from said washing tub and to re-admit liquid into a second region of said washing tub, said second region being a lower portion of said washing tub, wherein said second recirculation circuit comprises a second recirculation pump configured to force liquid inside said second recirculation circuit directly from said washing tub and to re-admit said liquid into said second region, and said second recirculation circuit is configured to mix said liquid with washing/rinsing products accumulated in said second region.

2. A machine according to claim 1, further comprising a first filtering device fluidly connected to an outlet of said washing tub, wherein said first recirculation pump is connected to a first outlet of said first filtering device and said second recirculation pump is connected to a second outlet of said filtering device.

3. A machine according to claim 2, wherein said first outlet of said filtering device and said second outlet of said filtering device are arranged at opposite sides with respect a central plane intersecting said first filtering device.

4. A machine according to claim 2, wherein said liquid outlet circuit comprises a draining pump, said draining pump being connected downstream of said first filtering device.

5. A machine according to claim 2, wherein said liquid outlet circuit comprises a draining pump, said draining pump being connected downstream of a second filtering device.

6. A machine according to claim 1, wherein said first region of said washing tub is a higher region with respect to said second region of said washing tub.

7. A machine according to claim 1, wherein said first recirculation circuit is arranged such that recirculated liquid is conveyed to the laundry, so as to wet the laundry.

8. A machine according to claim 1, wherein said second recirculation circuit re-admits liquid into said second region of said washing tub so as to improve dissolution of the washing/rinsing product collected therein.

9. A machine according to claim 8, wherein said second recirculation circuit re-admits liquid into a lower seat of said washing tub which receives a heater device.

10. A machine according to claim 1, wherein said first recirculation pump and said second recirculation pump are mounted on a support body, said support body being a single piece construction.

11. A machine according to claim 10, wherein said support body comprises:

a first inlet and a first outlet for said first recirculation pump; and a second inlet and a second outlet for said second recirculation pump.

12. A machine according to claim 1, wherein the machine is a laundry washing-drying machine.

13. A machine according to claim 1, wherein the first recirculation pump is configured to force liquid inside the first recirculation circuit separate from the second recirculation circuit, and wherein the second recirculation pump is configured to force liquid inside the second recirculation circuit separate from the first recirculation circuit.

14. A machine according to claim 1, wherein the first recirculation pump is configured to activate independently of activation of the second recirculation pump.

* * * * *